United States Patent [19]

Nagao

[11] Patent Number: 4,626,951

[45] Date of Patent: Dec. 2, 1986

[54] SINGULAR HOUSING OF SWITCH AND PROTECTIVE SEMICONDUCTOR

[75] Inventor: Yoshiaki Nagao, Owariasahi, Japan

[73] Assignee: Mitsubishi Denki Kabushiki Kaisha, Tokyo, Japan

[21] Appl. No.: 613,123

[22] Filed: May 23, 1984

[30] Foreign Application Priority Data

May 23, 1983 [JP] Japan ..... 58-90275

[51] Int. Cl.[4] ..... H01H 9/30

[52] U.S. Cl. ..... 361/8; 361/2; 361/3; 361/13; 335/1; 335/151

[58] Field of Search ..... 361/2, 3, 8, 13; 200/14; 335/155, 156, 131

[56] References Cited

U.S. PATENT DOCUMENTS

| | | | |
|---|---|---|---|
| 2,540,466 | 2/1951 | Welch | 361/13 |
| 3,372,288 | 3/1968 | Wigington | 361/6 |
| 3,588,605 | 6/1971 | Casson | 361/13 |
| 3,651,437 | 3/1972 | Kiyoshi | 335/131 |
| 3,982,137 | 9/1976 | Penrod | 361/8 |
| 4,162,514 | 7/1979 | De Bruyne | 361/2 |

*Primary Examiner*—A. D. Pellinen
*Assistant Examiner*—H. L. Williams
*Attorney, Agent, or Firm*—Armstrong, Nikaido, Marmelstein & Kubovcik

[57] ABSTRACT

A switch comprises a mechanical switch element having contacts and a semiconductor switching element, the mechanical switching element and semiconductor element being connected in series or in parallel with each other with respect to the output terminal and integrally formed in a housing. The semiconductor element and the connections thereto are embedded in an insulating material within the housing.

7 Claims, 4 Drawing Figures

SINGULAR HOUSING OF SWITCH AND PROTECTIVE SEMICONDUCTOR

BACKGROUND OF THE INVENTION

The present invention relates to a high power switch and more particularly to a switch which comprises a mechanical switching element which is electromagnetically actuated and a semiconductor switching element which is turned on or off in response to an electric signal.

The contact type switch has an advantage in that it may be made compact due to a low contact resistance between contacts and a low heat generation. On the other hand, however, it has disadvantages in that it includes consumable parts such as contacts and in that an extended period of time is required for inspection and maintainance when it is used for highly repetitive opening and closing operations.

The semiconductor switch in which the flow of an electric current is controlled by a semiconductor element such as a triac causes the current to flow without involving an arc generation and contact consumption to get a long service life. However the voltage drop is remarkable when the semiconductor switch is rendered conductive. It is therefore disadvantageous in that large scale cooling fins are necessary for radiating heat and some amount of leakage current flows since the current may not be completely cut off even when non-conductive.

In these circumstances, various efforts have heretofore been made to provide the advantages of both mechanical and semiconductor switches for compensating for the disadvantages of both thereof by arranging a plurality of mechanical switches and semiconductor switches. However, the use of the different types of two switches makes the switch arrangement very expensive totally and makes the occupation space of the both switches very large. It is not easy to adopt such combined use.

SUMMARY OF THE INVENTION

The present invention has been made under such circumstances and aims at providing a switch comprising a mechanical switching element and a semiconductor switching element, said mechanical and semiconductor switching elements being connected in series or in parallel to the output terminals and being integrally formed in a housing.

It is an object of the present invention to provide an independent single switch having advantages of both mechanical and semiconductor switches.

DETAILED DESCRIPTION OF THE EMBODIMENTS

Figure 1:
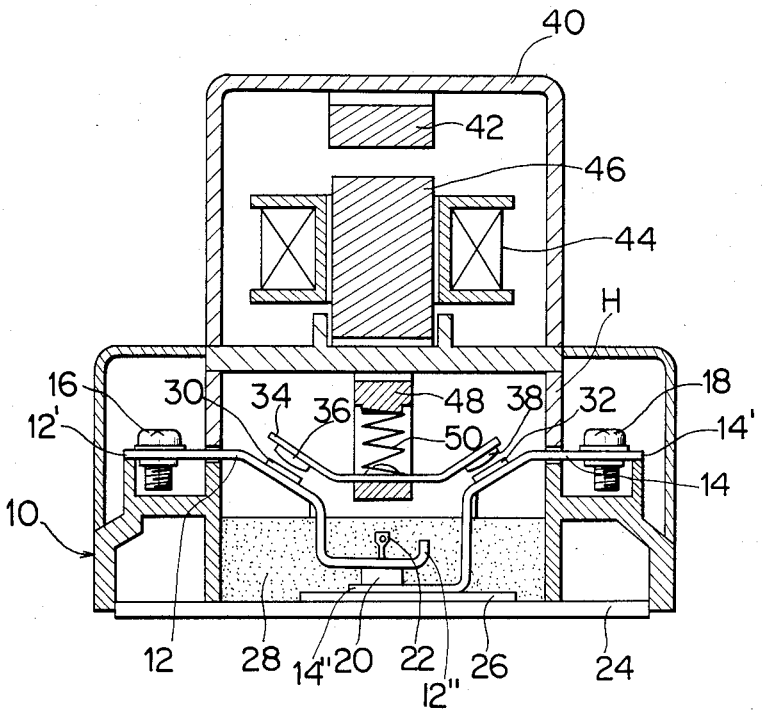
FIG. 1 is a sectional view showing a first embodiment of the present invention.

The present invention will be described with reference to preferred embodiments thereof which are illustrated in the drawings.

Figure 2:
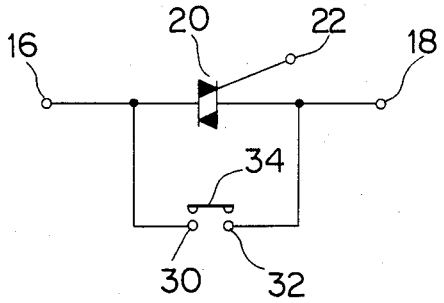
FIG. 2 is an equivalent circuit diagram showing the first embodiment of FIG. 1.

Referring now to FIG. 1, there is shown a first embodiment of the present invention. The switch according to one embodiment of the present invention comprises a mechanical switching element having contacts and a semiconductor switching element such as triac which are connected in parallel with each other as shown in an equivalent circuit diagram of FIG. 2.

For the mechanical switching element, first and second terminal plates 12 and 14 are secured to a mounting base 10 of a housing H to extend inside and outside said housing. Said terminal plates 12 and 14 have outside terminal ends 12' and 14' and inside terminal ends 12" and 14", respectively. Terminal screws 16 and 18 are disposed on the outside terminal ends 12' and 14' of the terminal plates 12 and 14 respectively.

The inside terminal ends 12" and 14" of the terminal plates 12 and 14 are disposed at upper and lower levels respectively. A semiconductor switching element 20 is sandwiched between the inside terminal ends 12" and 14" of the terminal plates 12 and 14 in a chip manner and welded thereto. The both electrodes of the semiconductor switching element 20 are electrically connected with the terminal plates 12 and 14. If the semiconductor switching element 20 has a gate terminal 22, the terminal 22 may be separately wired.

A metal plate 24 is joined to the lower side of the base 10. An insulating plate 26 is disposed between the metal plate 24 and the terminal plate 14. Said inside terminal ends 12" and 14" of said first and second terminal ends and the semiconductor switching element 20 in the cavity defined by the base 10 and the metal plate 24 are embedded in an insulating material 28 for the purpose of improving the mechanical strength, durability to the environment and the thermal conductivity.

Fixed contacts 30 and 32 are attached to the midpoints of the terminal plates 12 and 14 respectively by suitable means such as welding or caulking. There is also provided a moving contact plate 34 within housing H. Moving contacts 36 and 38 which are attached to said moving contact plate 34 by welding or caulking face to the fixed contacts 30 and 32, respectively.

The moving contact plate 34 is moved upward and downward by an electromagnetic device 40 secured on top of the housing H for closing or opening the fixed contacts 30 and 32. The electromagnetic device 40 comprises a fixed iron core 42, an electromagnetic solenoid 44 and a moving core 46. The moving contact plate 34 is connected via a spring 50 to a cross bar 48 secured to the moving iron core 46. The contact pressure between the fixed contacts 30 and 32 and the moving contacts 36 and 38 are produced by the spring 50.

In the afore-mentioned arrangement, closing or opening of the contacts of the moving contact plate 34 is controlled by the electromagnetic device 40. The switching operation of the semiconductor switching element 20 is gate-controlled. In the case where the present switch is to be rendered from off-state to on-state, a trigger signal is first applied upon the gate terminal 22 to turn the semiconductor switching element 20 conductive. The electromagnetic device 40 is then energized to close the mechanical contacts 30, 32, 36, and 38 with a slight time lag. This procedure makes the mechanical contacts come into contact under conducting condition. After the closing of the mechanical contacts an electric current flows through the mechanical contacts while little current flows through the semiconductor switching element 20 since the voltage drop in the mechanical contacts is lower that in the semiconductor switching element 20. In the case where the current is to be cut off by turning off the present switch from the on-state, the electromagnetic device 40 is deenergized to open the mechanical contacts 30, 32, 34 and 38 such that the moving contact plate 34 is caused to take an off-state and the semiconductor switching element is thereafter opened with a slight time lag. The electric current is cut off as it flows only through the semiconductor switching element 20 so that the present switch is turned off without generating any arc between the mechanical contacts. A timing control circuit which controls the sequence of turning on and off as explained above may include conventional circuits.

In the above-mentioned embodiment in which the moving contact plate 34 having the contacts 36 and 38 and semiconductor switching element 20 are arranged in parallel with each other across first and second terminal plates 12 and 14, the electric current flows through the semiconductor switching element 40 for only a short period of time when the present switch is being turned on and off. Thus, a switch having a long service life may be provided since the heat generation is small, reduction in size is possible and consumption of parts is effected only in the mechanical contacts.

Figure 3:
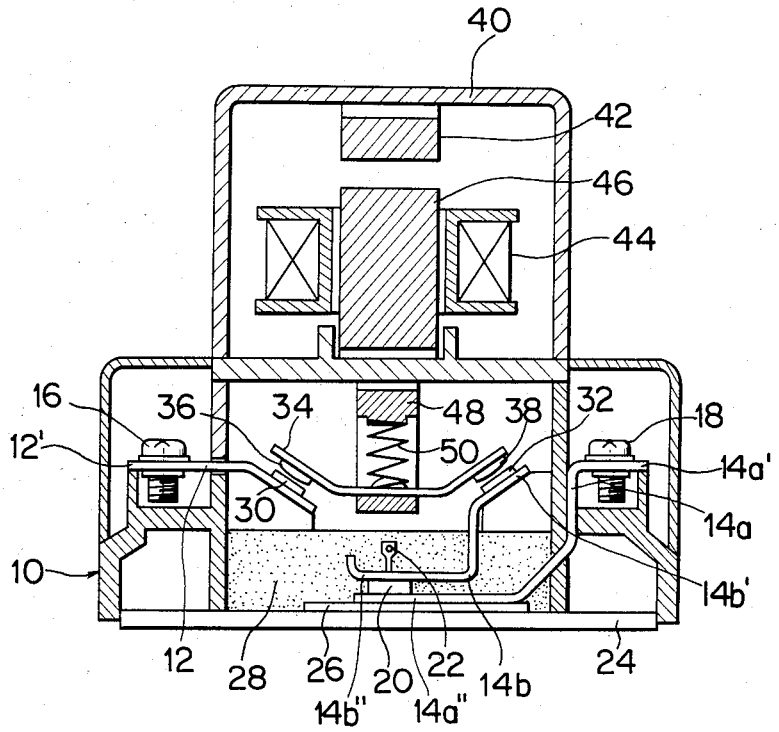
FIG. 3 is a sectional view showing a second embodiment of the present invention.
Figure 4:
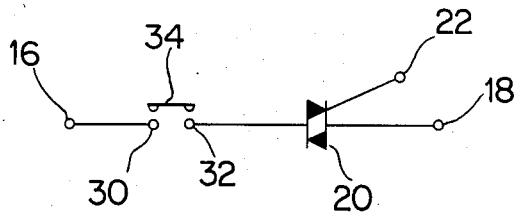
FIG. 4 is an equivalent circuit diagram showing the second embodiment of FIG. 3.

FIG. 3 shows a second embodiment of the present invention. The switch comprises a moving contact plate carrying contacts thereon and a semiconductor switching element which are in series connected as shown in the equivalent circuit diagram of the FIG. 4. The general structure of this embodiment is similar to that of FIGS. 1 and 2 except that the parallel connection is replaced with a series connection. That is, in addition to the second terminal plate 14*a*, there is further provided an auxiliary terminal plate 14*b* within said housing H. Said auxiliary terminal plate 14*b* has first and second terminal ends 14*b*′ and 14*b*″. Semiconductor switching element 20 is sandwiched between the second terminal end 14″ of the auxiliary terminal plate 14*b* and the inside terminal end 14*a*″ of the second terminal plate 14*a*. Further, fixed contact 32 is attached to said first terminal end 14*b*′ of the auxiliary terminal plate 14*b*. In case where the-current is required to flow, the mechanical contacts 30, 32, 34, and 38 are first closed and the semiconductor switch is then closed with a slight time lag. In case where the current is to be cut off, the semiconductor switching element 20 is first signalled to open and the contacts 30, 32, 34, and 38 of the mechanical switching element are then opened such that the moving contact plate 34 is caused to take an off-state with a slight time lag. A timing control circuit is adapted to control the sequence of the above switching procesure. This results in that the leakage current of the semiconductor switching element is shut off by the opening of the mechanical switch.

Although the moving contact plate 34 is actuated by the electromagnetic device 40 in both embodiments, the present invention should not be limited to these embodiments. It is apparent to those skilled in the art that various devices for actuating the contacts are applicable in lieu of the electromagnetic device 40.

What is claimed is:

1. A switch comprising:

a housing having a mounting base;

a pair of spaced terminal means each including a terminal plate extending inside and outside said housing and secured to said mounting base, each of said terminal plates having affixed thereto a switch contact;

a moving contact plate provided within said housing, said moving contact plate having affixed thereto a pair switch contacts, each adapted to come into and go out of contact with one of said contacts on said pair of terminal plates; and a semiconductor switching element electrically connected to at least one of said pair of terminal plates, said semiconductor switching element and the connection thereof to the terminal plate being positioned within said housing, said moving contact plate and said semiconductor switching element being arranged between said pair of terminal means.

2. A switch according to claim 1 wherein said moving contact plate is connected in parallel with said semiconductor switching element and is adapted to take an off-state before the semiconductor switching element is opened.

3. A switch according to claim 1, wherein said moving contact plate is connected in series with said semiconductor element and is adapted to take an off-state after the semiconductor switching element is opened.

4. A switch according to claim 1, wherein a first terminal means includes a first terminal plate having outside and inside terminal ends, a second terminal means includes a second terminal plate having outside and inside terminal ends, and said semiconductor switching element is connected to said inside terminal ends of said first and second terminal plates.

5. A switch according to claim 4, wherein said semiconductor switching element and said inside terminal ends of said first and second terminal plates are imbedded in an insulating material.

6. A switch according to claim 1, wherein a first terminal means includes a first terminal plate having outside and inside terminal ends, a second terminal means includes a second terminal plate having outside and inside terminal ends, and said switch further includes an auxiliary terminal plate provided within said housing and having first and second terminal ends, said moving contact plate being adapted to come into and go out of contact with the inside terminal end of said first terminal plate and the first terminal end of said auxiliary terminal plate, said semiconductor switching element being connected to the second terminal end of said auxiliary terminal plate and the inside terminal end of the second terminal plate.

7. A switch according to claim 6, wherein said semiconductor switching element, said inside terminal end of the second plate and the second terminal end of the auxiliary terminal plate are embedded in an insulating material.

* * * * *